United States Patent [19]

Vetter

[11] Patent Number: 4,907,781

[45] Date of Patent: Mar. 13, 1990

[54] LOW PRESSURE HOISTING AIR CUSHION HAVING AN AIRTIGHT CHAMBER WITH A VENTING MECHANISM

[75] Inventor: Manfred Vetter, Zuelpich, Fed. Rep. of Germany

[73] Assignee: Vepro GmbH, Zuelpich, Fed. Rep. of Germany

[21] Appl. No.: 13,666

[22] Filed: Feb. 12, 1987

[30] Foreign Application Priority Data

Feb. 13, 1986 [DE] Fed. Rep. of Germany ..... 3604435

[51] Int. Cl.[4] ..... B66F 3/24

[52] U.S. Cl. ..... 254/93 HP; 254/89 H

[58] Field of Search ..... 254/93 HP, 89 H, 93 R

[56] References Cited

U.S. PATENT DOCUMENTS

| | | | |
|---|---|---|---|
| 1,486,241 | 3/1924 | Gibson | 254/93 HP |
| 1,492,158 | 4/1924 | Caretta | 254/93 HP |
| 1,752,101 | 3/1930 | Meutsch | 254/93 HP |
| 3,026,541 | 3/1962 | Murat | 254/93 HP |
| 4,275,869 | 6/1981 | Clements | 254/93 HP |

*Primary Examiner*—Judy Hartman

*Attorney, Agent, or Firm*—K. S. Cornaby

[57] ABSTRACT

The low-pressure hoisting air cushion has an airtight chamber the walls of which (20) consist of a coated fabric which is elastic. Inserted into a hole (22) of the wall is a nozzle (24) of a valve. It consists of a tube socket accessible from the outside (26) and a ring-fastener (28) fitted internally. A compensation ring (34) is fitted between the ring-fastener (28) and the wall (20). It has a greater diameter than the ring-fastener (28) and is joined on one side to the ring-fastener (28) and to the wall on the other side (20) in such a way via a ring shaped joining area that there is created between both of them a circular shaped compensation zone (36) to which the compensation ring (34) is not attached on either side (FIG. 1).

8 Claims, 1 Drawing Sheet

LOW PRESSURE HOISTING AIR CUSHION HAVING AN AIRTIGHT CHAMBER WITH A VENTING MECHANISM

BACKGROUND OF THE INVENTION

The invention pertains to a low-pressure hoisting bolster or air cushion with an airtight chamber the wall of which consists of a fabric covered with rubber or synthetic material and is fitted with a valve having a nozzle which consists of a valve-socket inserted through a hole in the wall and a ring-fastener attached to it and to the inner side of the wall.

Low-pressure hoisting air cushions of the type mentioned initially are distinguished from high-pressure air cushions by the fact that the wall fabric is elastic. In high-pressure cushions, a cord or similar type of material capable of taking great pressure (which may be a type of steel or synthetic material) is incorporated into the substantially thicker walls. This cord so reinforces the walls of the cushion that expansion in the direction of the reinforcing is practically excluded. Low-pressure hoisting air cushions are, for example, manufactured in the range of 5 bar; whereas high-pressure air cushions can accommodate much higher pressures.

Low-pressure air cushions are known for example from English Patents 1,355,315 and 1,405,888. Both publications show cylinder-shaped hoisting cushions with a valve fitted in the cylinder jacket. This valve consists of a nozzle which is introduced through a hole in the cylinder jacket and which with its ring-fastener lies flat on the inside wall. The nozzle is made of rubber and its tube-shaped valve socket merges in one piece into the ring-fastener. The ring-fastener in particular has a wall strength considerably greater than the wall into which the nozzle is glued. In this way the material of the wall in the vicinity of the ring-fastener is appreciably strengthened with the result that the elasticity of the material is considerably reduced. If one moves from this area (which is thickened by the ring-fastener) to the outside the elasticity of the material of which the wall is composed abruptly sinks at the outer edge of the ring-fastener to an appreciably lower value, namely that of the normal material without reinforcing. In this area and somewhat beyond it there appear when the air cushion is inflated small creases which spread out radially and in essence radiate out from the central point of the hole in the wall. During inflation the wall-fabric of course stretches, but because the elasticity is greater beyond the reinforcing ring-fastener than in the neighborhood of the ring-fastener there inevitably occur at the transition points mentioned irregularities which manifest themselves in the small creases (they are referred to below as microcreases) to which attention has already been drawn. These place considerable stress on the cohesion between the ring-fastener and the wall fabric, and spot weaknesses occur in this adhesion, and loosening, and partial stripping. Thus leaks originate between the nozzle and the coated material which surrounds the hole in the wall. The air cushion becomes unserviceable and must, if it is possible, be repaired.

The reinforced area between the nozzle and the wall, more accurately that part between the ring-fastener of the nozzle and the coated material which encompasses the weak area, is the punch position of the familiar low-pressure air cushion. In consequence, the explosion limit (bursting point) of the existing cushions is for all practical purposes determined exclusively by the quality of this area of junction. But concerning the existing cushions their behavior over a long period of time is also influenced primarily by this area of junction because they too in every normal process of inflation completed with pressures well under the explosion limit form microcreases which in the course of time enlarge and cause leakages.

Taking these observations as its starting point the invention set out to avoid the disadvantages of the existing low-pressure hoisting air cushions noted initially and to develop the cushion further in such a manner that in spite of the implementation of elastic material for the wall no uneven areas, microcreases or the like should occur during inflation between the nozzle and the surrounding wall area so that the weakening of the uniformly consistent wall in the region of the hole does not result in a mechanical weakening of the whole cushion.

Proceeding from the low-pressure hoisting air cushion of the kind noted initially this task was solved by including between the ring-fastener and the wall a compensation ring which has a greater diameter than the ring-fastener and is preferably composed of a material which has a greater elasticity than the ring fastener and the material of the wall and which on one side is so attached to the ring-fastener and on the other side to the wall via a circular joining surface that between the inner edge of this circular joining surface and the outer edge of the ring-fastener there is preserved a circular compensatory zone over which the compensation ring is linked to neither the wall nor the nozzle.

The distinguishing factor of this low-pressure hoisting air cushion is the fact that the ring-fastener of the nozzle is not linked directly but rather by the insertion of the compensatory ring to the wall. In this way the compensating ring is linked on both sides (on the one side with the ring-fastener of the nozzle and on the other with the material of the wall) in such a way that there is created between both areas where it is joined-/attached a circulatory compensatory zone over which the compensatory ring remains free on both its sides. That is, it is not linked to any other part. This method of construction ensures that the nozzle can be moved backwards and forwards relative to the wall. In the low-pressure hoisting air cushions described initially such independent motion of the nozzle was impossible as it was linked directly to the wall fabric. When in use the relative moveability of the nozzle relative to the wall is not a negative factor because by reason of the internal pressure the ring-fastener is pressed against the inner side of the wall. In order to avoid the possibility that when the cushion is inflated the nozzle through ignorance or clumsiness is pressed too forcefully into the inner area (which would result in considerable overloading of the circular joining surface between the compensation ring and the wall) it is proposed in a future development so to reinforce the nozzle outside/beyond the hole that it can be pushed only marginally into the inner area of the cushion.

By reason of the compensation ring there results a carefully graduated transition to the hole in the wall and to the surrounding wall area on the one hand and on the other to the wall and to the nozzle. Because the hole with its inner edges is no longer linked directly to the nozzle but can be moved opposite it the weaknesses in the uninterrupted character of the wall area and the linkage between jacket and nozzle can result independently of each other and be dealt with most expeditely separately from each other. Thus in a further development of the invention the region around the hole can be reinforced by at least one reinforcing ring thereby preventing the development of tears at the edge of the hole. With respect to the nozzle the relatively stiff material of which it is made (generally rubber which is several millimeters thick) is no longer joined directly to the wall fabric; rather compensation is created via the compensation ring. As the material of the compensation ring has a greater elasticity than the material of the wall the relatively stiff nozzle influences only minimally the expansion process of the wall during inflation. With respect to the nozzle the uninterrupted, even quality of the wall is impaired only by the fact that the wall is thickened in the vicinity of the circular joining surface by the extra material of the compensation ring. On the other hand, this thickening protects the inner hole and can be so calibrated with the reinforcing rings mentioned that optimal conditions during inflation are created. In other words the fact that a hole must of necessity be fitted into the wall need not noticeably impair the mechanical expansion characteristics during inflation.

The advantage of the compensation ring pertinent to the invention is to be sought in the fact that production of the low-pressure hoisting air cushion remains simple and the area where nozzle and wall join is only minimally thickened it remains for all practical purposes as flat as in the existing low-pressure hoisting air cushions.

In its simplest form the compensation ring is a simple washer which is attached (preferably vulcanized) to the ring-fastener of the nozzle. The compensation zone is situated concentrically outside the described joining area while the circular joining area is outside of the compensation zone. The compensation ring can also be incorporated as a bellows. In its simplest form, it is composed of two washers similar to the one described initially. The lower washer is as described above joined to the ring-fastener of the nozzle (ideally by vulcanization) and is free at the adjoining ring area and joined to the second (upper) washer at its outer edge. This second washer is joined to the material surrounding the hole in the wall at the region of the inner ring.

The last-mentioned solution is more complicated and not as cheap as the solution with just one washer as compensation ring but it does have the advantage that the total diameter can be smaller and the join be effected directly in the vicinity of the hole.

BRIEF DESCRIPTION OF THE DRAWINGS

Further advantages and characteristics of the invention emerge from the other claims as well as from the following description of three models or examples. These instances which are explained below with reference to the diagram are not to be understood as limiting the claims of the patent. In this drawing:

DETAILED DESCRIPTION OF THE PREFERRED EMBODIMENTS

Figure 1:
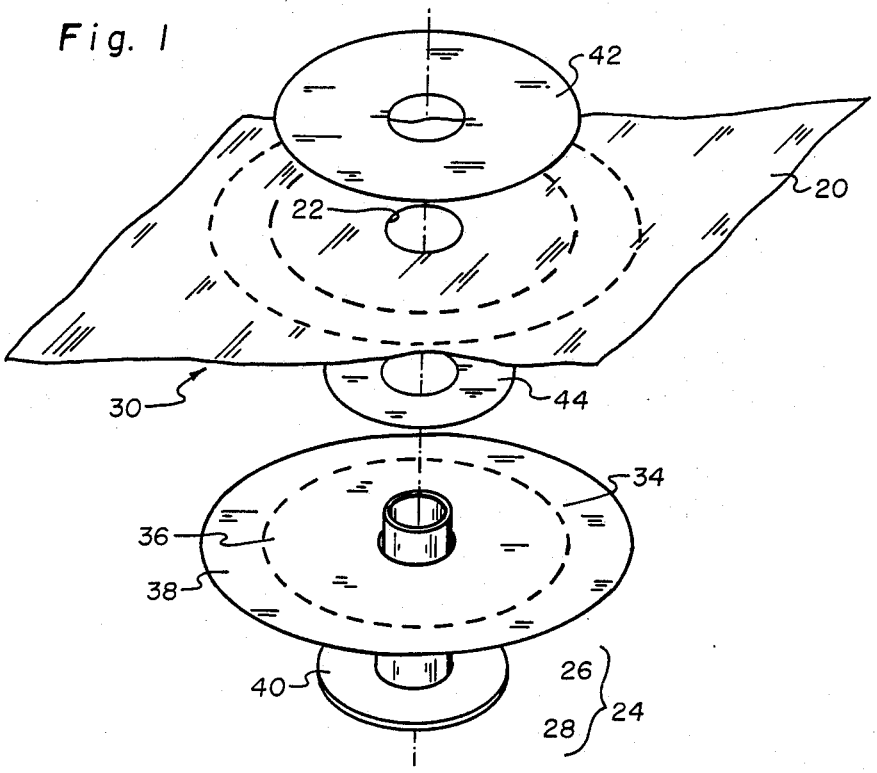
FIG. 1 shows a composite picture of the valve area of a low-pressure hoisting air cushion with a compensation ring in the form of a washer and two reinforcing rings.

In FIG. 1 is demonstrated part of a wall (20) of a low-pressure hoisting air cushion. This area forms together with the other areas an airtight chamber of for example cylindrical or cube shape. The wall (20) is cut from a material coated with a rubber or synthetic layer and has at this spot a thickness of for example 0.8 mm. Shown is the area around a hole (22) of the wall (20) for the insertion of a nozzle (24) of a valve fitted into the wall (20) but not demonstrated in the drawing. The valve consists of a tube-shaped valve socket (26) which is fitted through the hole (22) and of a ring-fastener (28) joined to it and the inner side of the wall.

Figure 2:
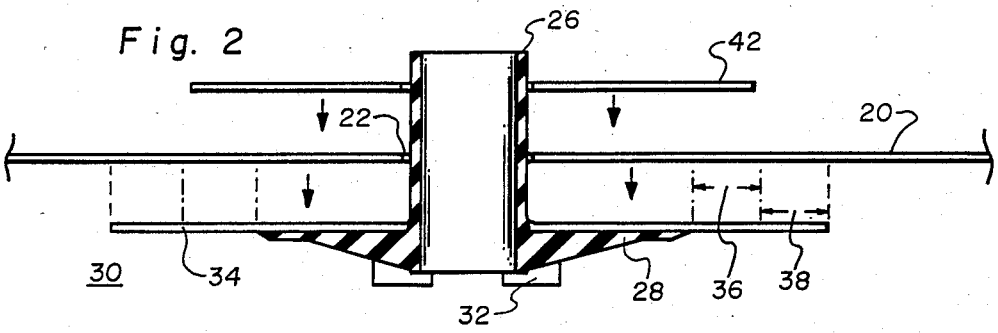
FIG. 2 shows an axial cross section through a composite picture similar to FIG. 1 but with just one reinforcing ring.
Figure 3:
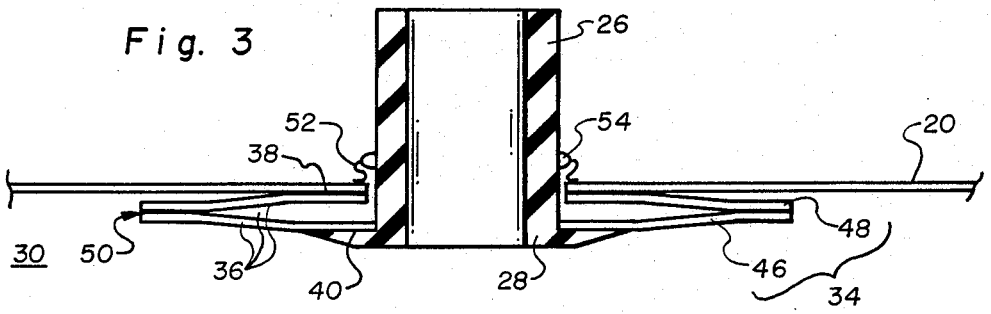
FIG. 3 shows a cross section similar to FIG. 2 but with a compensation ring which is composed of two washers.

The nozzle (24) is made in one piece of rubber, the tube socket (26) has a wall-thickness of approximately 4 mm. and a total length of perhaps 5 cm., the ring-fastener (28) has for example a diameter of 11 cm., the thickness of the material of the ring fastener decreases externally from a portion where the ring fastener is fixed to the tube socket (26) as is especially evident from FIGS. 2 and 3. In addition it has elongations (30) which point inward, for example wedges (32) which ensure that the inside end of the tube socket (36) cannot be closed of by any part of the wall when in the collapsed state.

The coated wall fabric (20) is elastic, the amount of elasticity being determined for all practical purposes solely by the material used. A KEFLAR-fabric for example demonstrates a very low stretching/tearing factor of just 4%, nylon fabrics used double have for example a stretching/tearing factor of 20%, for single layer fabrics the factor is even higher.

A compensation ring (34) is joined to the nozzle (24) ideally by vulcanization, although gluing may in certain circumstances also suffice. This ring is displayed in the finished model described in FIG. 1 as a simple disk which has an external diameter approximately double the external diameter of the ring-fastener (28). Its inner hole has an uninterrupted diameter which is somewhat greater than the external diameter of the tube socket (26). The compensation ring (34) should be ideally manufactured from a fabric which has been coated with rubber and which has a greater elasticity than that of the material used for the wall (20). It is most advantageous to use a material coated with rubber in order to join the compensation ring (34) by a process of vulcanization to the ring-fastener (28) and the transition piece to the tube socket (26). In manufacturing an air cushion, the section consisting of nozzle (24) and compensation ring (34) is manufactured beforehand and then joined to the other components. These other sections are still to be described.

In the event that the wall material (20) a KEFLAR-fabric is used a two-layered nylon fabric for example is employed for the compensation ring. If the wall (20) is made of two-layered nylon fabric, the compensation ring (34) for example is made of a single-layered nylon fabric.

As represented in FIG. 1 the compensation ring (34) is linked/joined annularly on its underside and a really to the nozzle (24). In the corresponding area of its upper surface and on both sides of a circular compensation zone which adjoins it, the compensation ring (34) remains free on. As represented in FIG. 1, it is glued at its upper side in a circular area (38) which lies outside of the circular compensation zone (36) to the wall (20), the corresponding glued area of the inside of the wall (20) is shown in broken lines in FIG. 1. The glued area must of necessity run concentric to the hole (22) which represents a break in the continuum.

Further reinforcing of the edge of the hole (22) is provided by two reinforcing rings (42, 44) demonstrated in the illustrated model. They too are also shaped as washers but compared to the compensation ring (34) they have different (which is to say graduated) diameters, the external diameters being selected so that the wall (20) is successively reinforced as one proceeds from a circular area where the joint is effected (40) to the hole (22). Thus the outer reinforcing ring (42) has an external diameter which is somewhat greater than the diameter of the outer edge of the compensation zone (36), thereby preventing that an area of the wall between the join area (40) and the reinforcing ring (42) misses out on being reinforced. The reinforcing ring (44) which is attached internally has an external diameter which is somewhat greater than the external diameter of the ring-fastener (28). The reinforcing here described so strengthens the area around the hole (22) that tears around the hole (22) cannot result even if pressures are employed which will cause the cushion to rupture. The reinforcing rings (42, 44) are joined by gluing to the wall (20).

The model represented in FIG. 2 (which figure also demonstrates the assembled state) differs essentially from the model represented in FIG. 1 only by reason of the fact that just one reinforcing ring (42) is inserted. The section which is composed of nozzle (24) and compensation ring (34) (this ring has the shape of a simple perforated disk) is shown here as a component part which has already been assembled. (In the drawing, the joining has been effected by vulcanization.) The wall (20) is placed on this section in the direction shown by the arrows and joined in the region of the joining surface (38) in a ring shape with the external edge of the compensation ring (34). The reinforcing ring (42), as was the case for the reinforcing rings (42, 44) shown in FIG. 1, is glued over its entire surface with the wall (20) centrically to the hole (22).

In the model demonstrated in FIG. 3, a type of bellows which is composed of two washers (46, 48) is employed as compensation ring (34). The lower washer (46), as has been demonstrated for all instances of compensation ring (34) cited in the previous examples, is joined areally to the ring-fastener (28) and the adjoining nozzle (24). At it outer edge it is joined ideally by vulcanization with the upper washer (48) via a ring-shaped area of joining (50). The upper washer too remains free on both sides on a circular area within this area of joining (50), and it is joined at its upper inner edge area to the inside of the wall (20) along the ring-shaped joining surface (38). The geometry is so calculated (although this is not absolutely necessary) that the joining surface (38) extends to the edge of the hole (22) and the inner hole of the washer in the form of a perforated disk (48) has the same diameter as the hole (22).

In FIG. 3 no reinforcing rings (42, 44) are shown. Such rings may nevertheless be employed both at the inside as well as at the outside of the wall (20). The model illustrated in FIG. 3 has the advantage that when reinforcing rings (42, 44) are employed the joining surface (38) is situated in the inner section of the reinforced area and not (as is the case in models illustrated in FIGS. 1 and 2) on the outer edge of the reinforced area. A reinforcing ring can also be employed between the wall (20) and the upper perforated disk (48) whereupon it will either protrude into the adjoining area (38) or be sited outside of it.

Because it is impossible during operation to prevent dust, dirt etc. from penetrating from the tube socket (26) and hole (22) to the region between the wall (20) and compensation ring (34) or between the perforated disks (46, 48) a very elastic, soft bellows (52) is inserted between the tube socket (26) and the outer side of the wall (20).

For actual use a metal nipple, as is well known, is inserted into the nozzle (24). This nipple is attached by means of a normal or standard clip such as is readily available. In addition, an external supporting nozzle encompasses the valve. These parts are not depicted as they are known.

I claim:

1. In a low pressure hoisting air cushion with an hermetically-sealed chamber, a wall of the cushion consists of a fabric covered by a rubber-like material and to a sheet of which is attached a valve containing a nozzle, in said nozzle which consists of a tube-shaped valve socket inserted through an aperture in the cushion wall and a ring-fastener attached to said valve socket at an inner side of said wall, an improvement comprising a flat circular disk compensation ring which is of greater external diameter than the ring fastener, wherein said ring exhibits a lower and an upper side, a ring-shaped first surface on the lower side whereby the compensation ring is fixed to said ring-fastener, a ring-shaped second surface on the upper side of the compensation ring whereby the compensation ring is fixed to the inner surface of the wall surrounding an aperture, and a ring-shape compensation area between said first and second ring-shaped surfaces, on which the compensation ring is linked neither with the wall nor with the nozzle.

2. Hoisting air cushion according to claim 1, characterized thus, that the compensation ring is manufactured of material which as greater elasticity than the ring-fastener and the material of the wall.

3. Hoisting air cushion according to claim 1, characterized thus, that on at least one side of the wall concentric to the aperture there is at least one reinforcing ring attached circumferentially.

4. Hoisting air cushion according to claim 3, characterized thus, that an external diameter of said reinforcing ring is greater than the diameter of the hole.

5. Hoisting air cushion according to claim 3 or 4, characterized thus, that an internal diameter of the reinforcing ring corresponds to the diameter of the hole.

6. Hoisting air cushion according to claim 1, characterized thus, that between the compensating and wall a soft bellows prevents dirt entering into the compensation ring.

7. In a low pressure hoisting air cushion with a hermetically sealed chamber, a wall of the cushion consists of a fabric covered by a rubber-like material and to a shell of which is attached a valve containing a nozzle, in which said nozzle consists of a tube-shaped valve socket inserted through an aperture in the cushion wall and a ring-fastener attached to said valve socket at an inner side of said wall, an improvement comprising a compensation ring which is of greater external diameter than the ring fastener, wherein the compensation ring is composed of at least two perforated disks which form a bellows, and wherein said compensation ring exhibits a lower and an upper side, one said perforated disk including a ring-shaped first surface on the lower side whereby the compensation ring is fixed to said ring-fastener by vulcanization, a second said perforated disk including a ring-shaped second surface on the upper side of the compensation ring whereby the compensation ring is fixed to the inner surface of the wall surrounding an aperture, and a ring-shaped compensation area between said first and second ring-shaped surfaces, on which the compensation ring is linked neither with the wall nor with the nozzle.

8. Hoisting air cushion according to claim 7, characterized thus, that an even number of perforated disks, are employed the aperture.

* * * * *

UNITED STATES PATENT AND TRADEMARK OFFICE

CERTIFICATE OF CORRECTION

PATENT NO. : 4,907,781

DATED : March 13, 1990

INVENTOR(S) : Manfred Vetter

It is certified that error appears in the above-identified patent and that said Letters Patent is hereby corrected as shown below:

Column 4, line 62, delete "a really", should read --areally--; line 66, delete "on".

Column 5, line 12, delete "the" should read --a--;

Column 6
Claim 1, line 4, delete "sheet", should read --shell--; line 19, delete "shape", should read --shaped--;
Claim 2, line 3, delete "as", should read --has--;
Claim 6, line 2, delete "compensating", should read --compensation ring--;
Column 8
Claim 8, line 3, delete "the aperture".

Signed and Sealed this

Twenty-first Day of May, 1991

*Attest:*

*Attesting Officer*

HARRY F. MANBECK, JR.

*Commissioner of Patents and Trademarks*